US007172256B2

(12) United States Patent
Sleep et al.

(10) Patent No.: US 7,172,256 B2
(45) Date of Patent: Feb. 6, 2007

(54) ROTARY CUTTING BIT HAVING SPARK SUPPRESSION SLEEVE

(75) Inventors: Keith Sleep, Glenella (AU); Steven Weaver, Maryland (AU)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 10/845,556

(22) Filed: May 14, 2004

(65) Prior Publication Data

US 2005/0212345 A1 Sep. 29, 2005

(30) Foreign Application Priority Data

Mar. 26, 2004 (AU) ..... 2004201284

(51) Int. Cl.
*E21C 35/183* (2006.01)

(52) U.S. Cl. ..... 299/105; 299/104

(58) Field of Classification Search ..... 299/102–107, 299/110–111, 113
See application file for complete search history.

(56) References Cited

U.S. PATENT DOCUMENTS

| | | | | |
|---|---|---|---|---|
| 4,725,098 A | | 2/1988 | Beach | |
| 4,944,559 A | * | 7/1990 | Sionnet et al. | 299/105 |
| 5,417,475 A | * | 5/1995 | Graham et al. | 299/105 |
| 5,823,632 A | | 10/1998 | Burkett | |
| 6,113,195 A | | 9/2000 | Mercier et al. | |
| 6,196,636 B1 | | 3/2001 | Mills et al. | |
| 6,709,065 B2 | * | 3/2004 | Peay et al. | 299/104 |
| 2005/0035649 A1 | * | 2/2005 | Mercier et al. | 299/105 |

FOREIGN PATENT DOCUMENTS

| | | | |
|---|---|---|---|
| DE | 42 26 976 | | 2/1993 |
| DE | 10163717 | * | 12/2001 |
| EP | 0 274 645 | | 7/1988 |
| GB | 2 002 314 | | 2/1979 |
| GB | 2 037 223 | | 7/1980 |
| RU | 911024 | * | 3/1982 |

* cited by examiner

*Primary Examiner*—Sunil Singh
(74) *Attorney, Agent, or Firm*—Drinker Biddle & Reath LLP

(57) ABSTRACT

A cutting pick includes an elongate shank, a cutting tip fixed to one end of the shank to project from that end and which is of a material that is harder than the material of the shank, and an annular sleeve which is attached about the shank adjacent the cutting tip. The sleeve is of a material (e.g., tungsten carbide) which is harder than the material of the shank and which has a lower propensity for incendive spark production during a cutting operation than the material of the shank. The sleeve includes a plurality of annular sleeve portions which are attached about the shank immediately adjacent to each other.

12 Claims, 3 Drawing Sheets

ROTARY CUTTING BIT HAVING SPARK SUPPRESSION SLEEVE

This application claims priority under 35 U.S.C. § 119 and/or 365 to Patent Application Serial No. 2004.201284 filed in Australia on Mar. 26, 2004, the entire content of which is hereby incorporated by reference.

BACKGROUND OF THE INVENTION

The present invention relates to cutting tools used for mining and excavation purposes. The present invention has been developed principally for use in the mining of coal and in that use, typically underground coal mining. It will therefore be convenient to describe the invention in relation to that use although it will be readily appreciated that the invention could be employed for any mining or excavation operation to which its function is suitable.

Various different forms of equipment and machinery can be employed for mining and excavation operations, and typically it is the type of mining or excavation taking place, and the type of earth being mined or excavated, that dictates the type of equipment and machinery that is appropriate. The present invention is principally concerned with underground coal mining and one of the major safety difficulties is that type of mining relates to fires or explosions within the mine. These can occur due to the generation during mining of methane gas and coal dust (commonly known as mine dust), which can be trapped within the mine and is readily ignitable. Disadvantageously, the equipment used in coal mining can generate incendive sparks and thus cause fires or explosion. As used herein, incendive means capable of causing fire, i.e. incendiary. Therefore, it is important that all appropriate steps be taken to minimize or eliminate the production of sparks.

Equipment used to mine or excavate in hard earth can include rotary cutters, in which a rotating drum that carries a plurality of projecting cutting bits or picks, is brought into engagement with an earth face. The picks bite into the earth face as they rotate with the drum, to impact against and to dislodge or fragment earth from the face. This highly aggressive engagement between the picks and the earth face can result in spark production between them.

Picks employed for the above purpose generally have a hard cemented tungsten carbide tip that is fixed, usually by brazing, to a steel shank. Picks of this kind are disclosed in various prior art, such as U.S. Pat. No. 6,113,195, EP-0274645 and DE-4226976. The tip of the picks can be either of the insert or cap style.

The insert style is shown in DE-4226976, in which a greater section of the axial length of the tip is anchored within a bore of the shank, than extends out of the bore. The cap style is shown in EP-0274645, in which the tip has a broader base than the insert style tip and the base is located and brazed into a relatively shallow recess in the forward end of the shank. The present invention is applicable to either of these forms of pick.

In picks of the above kind, sparks can be produced between the tungsten carbide tip and the earth face and also between the steel shank and the earth face, although there typically is greater likelihood of spark production between the shank and the earth face.

It is an object of the present invention to provide a cutting pick which has a reduced likelihood of producing a spark during mining or excavation operations, in particular underground coal mining.

SUMMARY OF INVENTION

According to the present invention there is provided a cutting pick which comprises an elongate shank and a cutting tip fixed to one end of the shank to project from that end, the cutting tip is of a material which is harder than the material of the shank and an annular sleeve is attached about the shank, adjacent the cutting tip, the sleeve being of a spark resistant material which has a lower propensity for incendive spark production during a cutting operation than the material of the shank.

By the attachment of the sleeve about the shank, the portion of the shank in the immediate vicinity of the cutting tip, which typically is the most likely to contact either the earth face being cut, or the fragments of earth being dislodged from the face, and to therefore generate an incendive spark, is shielded against that contact by the spark resistant material. The propensity for spark production is therefore reduced.

In a cutting pick according to the invention, the elongate shank can take any suitable form, such as known forms, for fixing to a rotary cutting drum. The shank would usually be ref easably fixable to the drum so that worn cutting picks can be replaced as necessary and in some machinery, the shank is rotatably mounted so that the cutting pick can freely rotate about its lengthwise axis as it engages an earth face. The shank usually would be manufactured from steel.

In a cutting pick according to the invention, the shank can be configured to receive either an insert style cutting tip or a cap style cutting tip.

In a cutting pick according to the invention, the cutting tip can be manufactured from any suitable material which is harder than the shank material, and the preferred cutting tip material is cemented tungsten carbide. The tip can also be diamond impregnated for increased hardness or can include cubic boron nitride for the same purpose. The cutting tip can have any suitable shape, which typically is dependent on whether the tip is of the insert or cap style. The cutting tip usually is brazed to the shank, although other arrangements for fixing the tip, such as by chemical adhesives, can be employed.

The sleeve which is attached about the shank adjacent the cutting tip preferably is formed from the same material as the cutting tip and preferably that material is a cemented tungsten carbide. Alternatively the material could be or include SiC, $Al_2O_3$, TiN, SiC-D (silicon carbide diamond composite), cubic boron nitride, tool steel, or other like materials. These materials can be formed as a composite material with other suitable materials, or they may be provided as an outer layer or layers over a suitable base.

In a typical size of cutting pick, the axial height of the sleeve could be in the region of about 10 mm to 15 mm, with the radial thickness of the sleeve between inner and outer diameter, about 3 mm to 5 mm. Production of a sleeve in these dimensions in tungsten carbide may present certain difficulties and therefore it is preferable that the sleeve be produced in sleeve portions or rings of reduced height, such as about 4 mm in axial height. These portions can then be attached to the shank to form a composite sleeve of the required height. In the preferred arrangement, three sleeve portions are employed, although two sleeve portions, or four or more, may be employed as required. In a preferred arrangement, each sleeve portion has the same inside and outside diameters, and preferably the inner and outer surfaces are parallel, although the outer surface can include a chamfered edge or edges to reduce the likelihood of sharp edge breakage.

The envisioned difficulty with a sleeve formed of one piece relates principally to the difference in the coefficient of expansion between the sleeve and the shank when the sleeve is attached to the shank. If the shank material is steel and the sleeve is tungsten carbide, the shank will expand as the steel is heated and the shank will thereafter shrink while the steel cools at a rate which is about twice as fast as that of the sleeve. The difference in rate of shrinking can introduce stresses in the sleeve, which typically will be more brittle than the shank and if the stresses are sufficient, the sleeve can crack. If a plurality of shank portions in the form of rings are employed, then the contact area between the shank and the composite sleeve can be reduced by breaks between the rings. This is because the medium employed to fix the rings to the shank extends between the rings and the shank and between the rings themselves. That medium, which is, as later described, preferably braze, can absorb some of the induced stresses and therefore reduce the likelihood of the sleeve failing. This has the additional benefit that the composite sleeve can be tougher or stronger than a single-piece sleeve, so that the likelihood of wear or failure under operating loads is also reduced.

In a preferred form of a cutting pick according to the invention, the shank defines a shoulder between a generally conical section and cylindrical section. The conical section converges towards the cylindrical section, while the cylindrical section defines a recess for receipt of a base portion of the cutting tip. That receipt can constitute either an insert or cap style cutting pick. In this arrangement, the sleeve is attached to the shank about the cylindrical portion and is supported against the shoulder. Advantageously, this arrangement provides for accurate location of the sleeve on the shank and provides a surface against which the sleeve can react impact loads during a cutting operation.

A shank of the above kind can define a second shoulder, which is axially spaced from the first shoulder in a direction away from the cutting tip, and in this arrangement, a second sleeve can be attached about the shank to extend between the first and second shoulders. In this manner, a further portion of the shank can be protected against contact with the earth face and so further lessen the risk of incendive spark production.

The arrangement discussed above in which a second shoulder is provided, can be repeated as required, to create a third shoulder and further shoulders as necessary. Accordingly, by this arrangement, an ever increasing axial length of the shank can be protected.

In the arrangements discussed above, when more than a single shoulder is provided, it is preferable that the shank portions between the respective shoulders are cylindrical and that each portion increases in diameter in a direction away from the cutting tip.

In the preferred arrangement, in which the shank is formed of steel and the sleeve or sleeves is/are formed from tungsten carbide, the preferred form of attachment of the sleeve to the shank, is by brazing. In the embodiment in which the sleeve is comprised of a plurality of sleeve portions, it is preferred that each portion is individually brazed to the shank and to each other.

While tungsten carbide is the preferred material for the sleeve, other materials, such as those discussed above, may be equally appropriate. Likewise, the material can include additives which enhance either the resistance to incendive spark production or which increase the wear resisting capacity of the sleeve. In this latter respect, the sleeve for example, can be enhanced by the addition of diamond particles. Other additives of the above discussed kinds may be equally appropriate. Alternatively, the material may be a composite of a base, which has a suitable outer layer or layers applied to it, and for this titanium nitride is most preferred.

It will be appreciated that the above discussion principally concerns the reduction or elimination of incendive spark production, during engagement of a cutting pick with an earth face. While that result is the primary achievement of the invention, a secondary aspect of the invention, is to provide the shank with a resistance to wear. Shanks formed from steel, readily wear over time, and it is often the case that the steel shank wears more quickly than the harder cutting tip, so that the cutting pick must be replaced earlier than desirable i.e. before the cutting pick is sufficiently worn. In other words, wear of the shank can reduce the effective life of the cutting pick. Pick wear often occurs principally in the vicinity of the shank immediately adjacent the cutting tip. Accordingly, by suitable selection of sleeve material, the steel shank in that vicinity can be shielded against engagement with earth face or fragments, that would otherwise cause it to wear and therefore the life of the cutting pick can be improved. The selection of a sleeve material that is the same or effectively equivalent to the material of the cutting tip, can provide useful wear resistance for this purpose.

The present invention also provides a method of using a cutting pick of any of the kinds described above, for mining in a gas and/or mine dust environment.

BRIEF DESCRIPTION OF DRAWINGS

For a better understanding of the invention and to show how the same may be carried into effect, a preferred embodiment thereof will now be described, by way of non-limiting example only, with reference to the accompanying drawings.

DESCRIPTION OF A PREFERRED EMBODIMENT OF THE INVENTION

Figure 1:
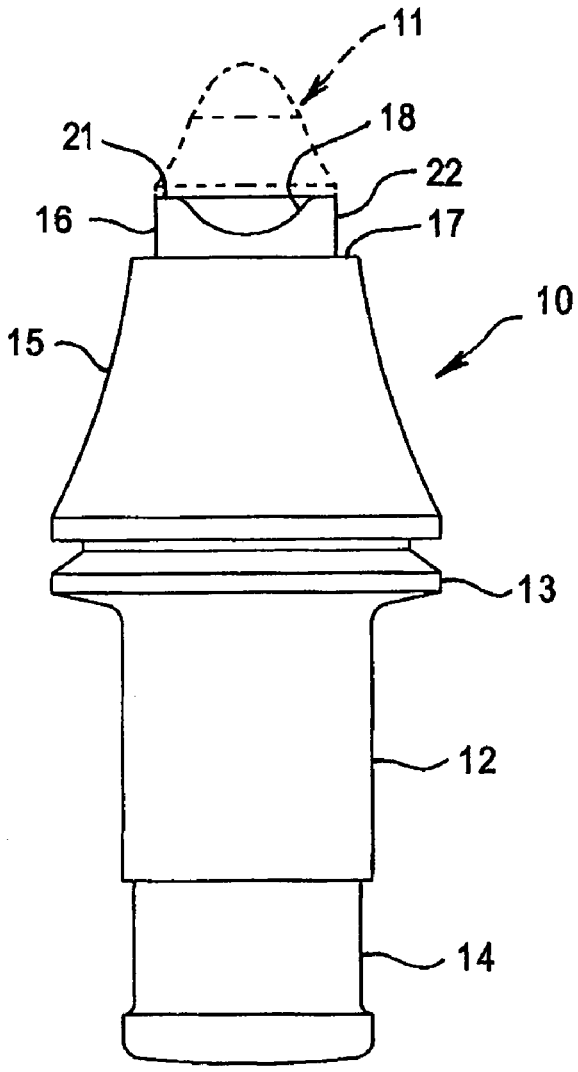
FIG 1 (PRIOR ART)
FIG. 1 is a side view of the shank of a prior art rotary cutting pick.
Figure 2:
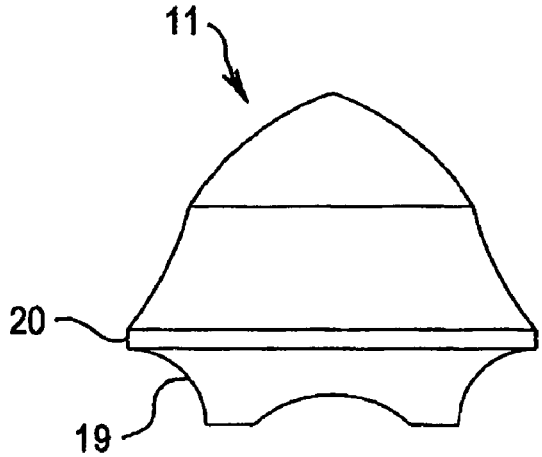
FIG 2 (PRIOR ART)
FIG. 2 is a side view of a tungsten carbide tip for attachment to the shank of FIG. 1.

FIGS. 1 and 2 respectively show a shank 10 of a cutting pick, and a tungsten carbide tip 11 which is shaped for attachment to the shank 10. The shank 10 includes a body section 12, which includes a flange 13 at one end and a recess 14 remote from the flange 13, and whereby the flange 13 and the recess 14 cooperate with a rotary cutting drum for fixing of the cutting pick to the drum. The manner with which the shank 10 is fixed to the drum will be known to a person skilled in the art and therefore will not be further described or illustrated herein.

The shank 10 further defines a substantially conical portion 15, a cylindrical portion 16 and a shoulder 17. It will be appreciated that the shoulder 17 is defined by a reduction in the diameter of the conical portion 15 immediately adjacent the cylindrical portion 16.

The cylindrical portion 16 includes a recess 18 for receiving a base portion of a cutting tip, such as the kind shown in FIG. 2. Referring to that figure, it will be appreciated that the cutting tip 11 is not shown to scale for attachment to the shank 10, but instead is shown larger to clearly show relevant detail. The cutting tip 11 includes a base portion 19 which extends to a maximum diameter ring 20 and it is at the base portion 19 which is received within the recess 18 of the shank 10. The ring 20 rests against the upper edge 21 of the cylindrical portion 16, when the cutting tip 11 is fixed to the cylindrical portion 16. That fixing typically is achieved by brazing the cutting tip 11 within the recess 18. FIG. 1 shows in broken outline, the cutting tip 11 fixed to the cylindrical portion 16.

It will be appreciated from FIG. 1, that when the cutting tip 11 is fixed to the shank 10 each of the outer cylindrical surface 22, the shoulder 17 and the outer surface of the conical portion 15 remain exposed. Thus, these surfaces can come into contact with the earth face being cut, or with fragments that have been dislodged from the earth face. That engagement can result in incendive sparks being produced, with the obvious potential hazardous consequences. The likelihood of spark production is greatest in the sections of the shank 10 adjacent the cutting tip 11, while the likelihood reduces towards the opposite end of the shank 10.

Figure 3:
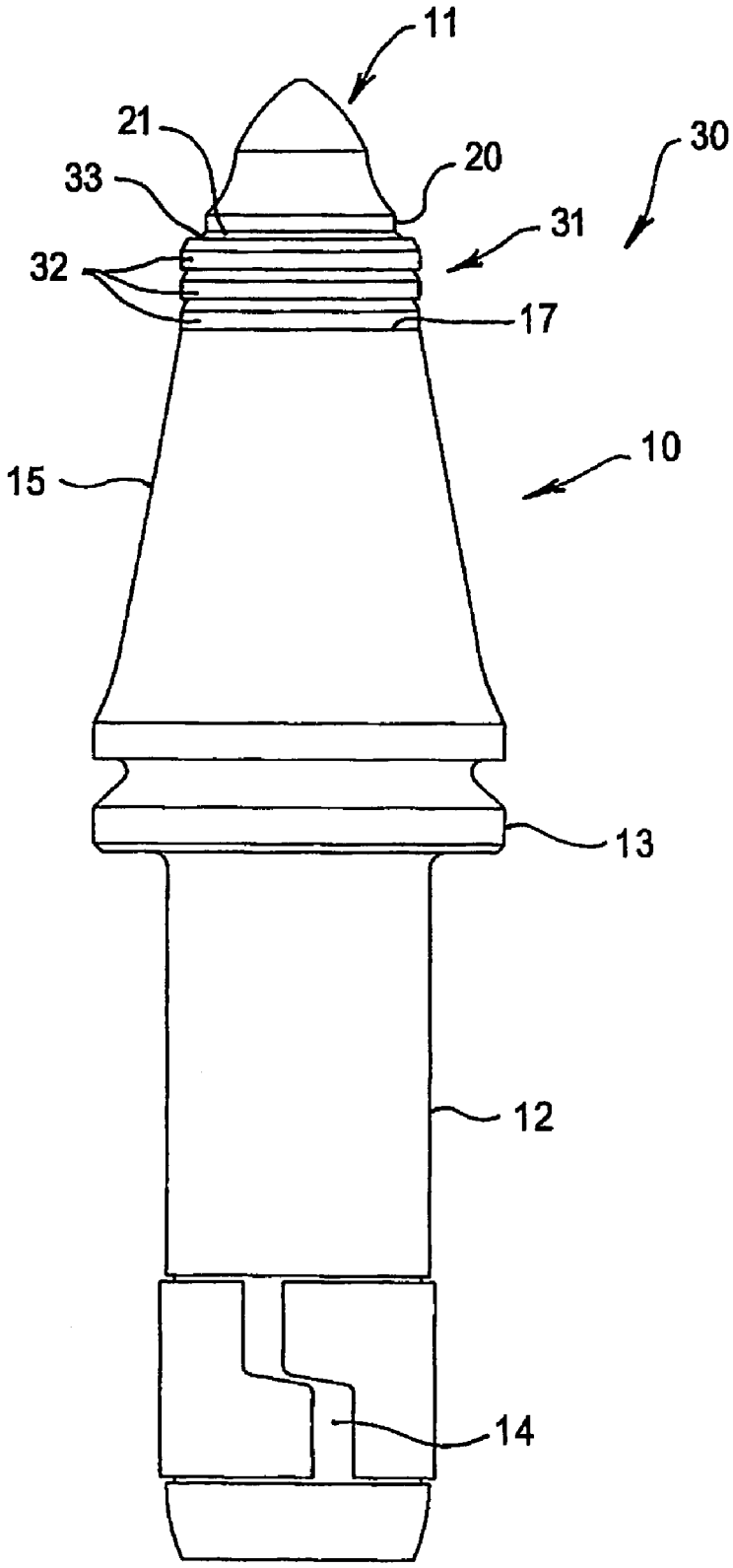
FIG. 3 is a side view of a cutting pick according to the invention.

FIG. 3 illustrates an embodiment of the invention, in which the likelihood of spark production is reduced. The cutting pick 30 of FIG. 3 employs the shank 10 and cutting tip 11 of FIGS. 1 and 2 and therefore the same reference numerals as used in those figures are employed in FIG. 3.

In FIG. 3, a composite sleeve 31, formed of three identical sleeve portions or rings 32, is disposed about the outer cylindrical surface 22 (FIG. 1) of the cylindrical portion 16. Each of the rings 32 is formed separately from one another, and is fitted about the cylindrical portion 16 in a snug or slightly frictional fitting, and is brazed to the outer surface 22, and the most remote ring 32 from the cutting tip 11 is also brazed to the shoulder 17. As shown, the rings 32 provide substantially complete protection for the outer surface 22 of the cylindrical portion 16, with only a slight section of the cylindrical portion 16 visible axially beyond the most immediately adjacent ring 32 to the cutting tip 11. That section is identified by the reference numeral 33 and is the section of the cylindrical portion 16 to which the flange 20 of the cutting tip 11 is fixed.

The sleeve 31 is produced in separate rings, which promotes ease of sleeve production and attachment to the shank 10. Rings 32 of the dimensions shown in FIG. 3 are more easily produced from tungsten carbide, than would be a single composite sleeve which has an axial dimension equal to the three axially adjacent rings. Also, by separately brazing each ring 32 in turn to the cylindrical portion 16, a more firm attachment of the composite sleeve 31 to the shank 10 is achieved. Also, the use of rings 32 to form a composite sleeve allows the axial height of the sleeve to be increased or decreased relative to the axial extent of the cylindrical portion 16. That is, sleeves of different axial dimensions need not be produced; it is simply necessary to choose the appropriate number of rings 32 for the axial sleeve height required.

It will be seen from FIG. 3, that each of the rings 32 has a chamfer applied to the leading axial edge thereof in the direction of the cutting tip 11.

Figure 4:
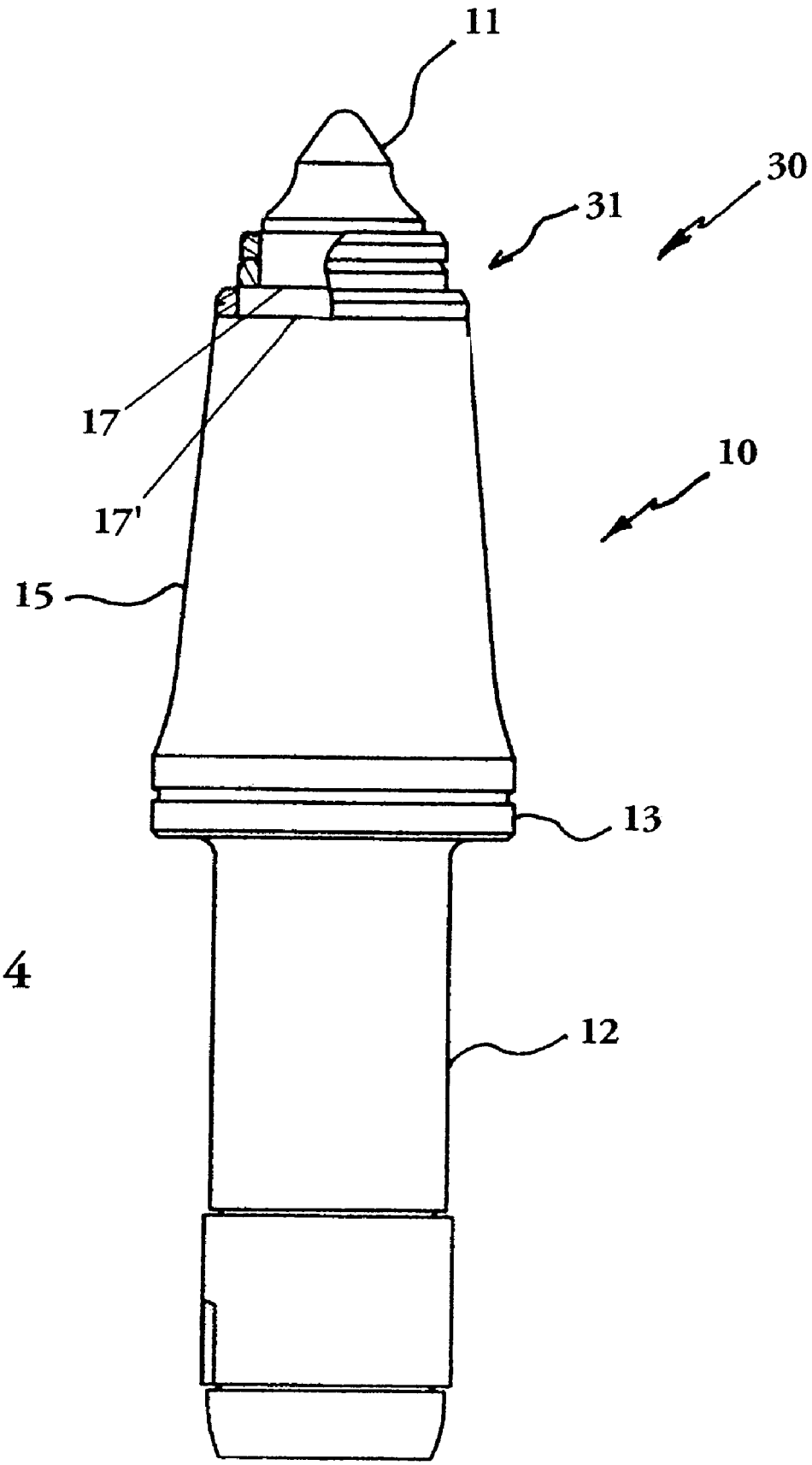
FIG. 4 is a side view of a cutting pick according to the invention.

It will be further appreciated, that the axial length of the sleeve 31 could be extended in the direction towards the flange 13, and for this the conical portion 15 of the shank 10 can be stepped to provide a further series of shoulders 17', as illustrated in FIG. 4, or further sleeves could simply be attached to the outer surface of the conical portion 15. The necessity for continuing the sleeve protection towards the flange 13 is dependent on the likelihood of incendive spark production further behind the shoulder 17. Present thinking indicates that a substantial reduction in the potential for incendive spark production is achieved by a sleeve 31 having the appropriate dimensions shown in FIG. 3, relative to the remaining components of the cutting pick 30.

It will be appreciated that by proper selection of the material of the sleeve 31, that the sleeve 31 will also provide wear protection for the cylindrical portion 16 of the shank 10. While wear protection is not its primary function, advantageously, this secondary function can significantly improve the life of the cutting pick. Moreover, the effect of the invention to reduce spark production can only occur while the sleeve remains intact. That is, if the sleeve wears away, the benefits of the invention will be lost. Accordingly, it is preferred that the sleeve resists wear for the anticipated life of the cutting pick.

The invention described herein is susceptible to variations, modifications and/or additions other than those specifically described and it is to be understood that the invention includes all such variations, modifications and/or additions which fall within the scope of the following claims.

What is claimed is:

1. A cutting pick comprising:

an elongate shank;

a cutting tip fixed to one end of the shank to project from that end and which is of a material that is harder than the material of the shank; and an annular sleeve which is attached about the shank adjacent the cutting tip, the sleeve being of a material which is harder than the material of the shank and which has a lower propensity for incendiary spark production during a cutting operation than the material of the shank, wherein the sleeve is comprised of a plurality of annular sleeve portions which are attached about the shank immediately adjacent to each other, wherein the plurality of annular sleeve portions comprises three sleeve portions, and wherein the three sleeve portions have the same inside and outside diameter.

2. A cutting pick comprising:

an elongate shank;

a cutting tip fixed to one end of the shank to project from that end and which is of a material that is harder than the material of the shank; and an annular sleeve which is attached about the shank adjacent the cutting tip, the sleeve being of a material which is harder than the material of the shank and which has a lower propensity for incendiary spark production during a cutting operation than the material of the shank, wherein the sleeve is comprised of a plurality of annular sleeve portions which are attached about the shank immediately adjacent to each other, and wherein the plurality of annular sleeve portions have the same inside and outside diameters.

3. A cutting pick comprising:

an elongate shank;

a cutting tip fixed to one end of the shank to project from the one end and which is of a material that is harder than the material of the shank; and a composite sleeve formed of a plurality of annular sleeve portions which are attached about the shank adjacent the cutting tip and immediately adjacent to each other, the sleeve portions being of a material which is harder than the material of the shank and which has a lower propensity for incendiary spark production during a cutting operation than the material of the shank, wherein the shank defines a first shoulder which extends substantially perpendicular to the lengthwise axis of the shank between a generally conical section and a cylindrical section, the conical section converging towards the cylindrical section and the cylindrical section defining a recess for receipt of a base portion of the cutting tip, the sleeve being attached to the shank about the cylindrical portion and being supported on the first shoulder.

4. A cutting pick according to claim 3, wherein the sleeve is generally cylindrical.

5. A cutting pick according to claim 4, wherein said shank defines a second shoulder axially spaced from the first shoulder in a direction away from the cutting tip and extending substantially perpendicular to the lengthwise axis of the shank, and another sleeve is attached about the shank and extends between the first and second shoulders.

6. A cutting pick according to claim 5, wherein the shank is cylindrical between the first and second shoulders and is of greater diameter than the cylindrical section which extends from the first shoulder away from the second shoulder.

7. A cutting pick comprising:

an elongate steel shank;

a cutting tip fixed to a cylindrical end section of the shank to project axially with respect to the lengthwise axis of the shank and which is of a material that is harder than the material of the shank; and a composite sleeve formed of a plurality of annular sleeve portions which are attached about the cylindrical end section and which are of a material that is harder than the material of the shank and which extend substantially the full height of the end section and which have a lower propensity for incendiary spark production during a cutting operation than the steel of the shank.

8. A cutting pick according to claim 7, wherein the plurality of annular sleeve portions are attached to the cylindrical end section in axially abutting relationship.

9. A cutting pick according to claim 8, wherein the plurality of annular sleeve portions is formed of three sleeve portions.

10. A method of using a cutting pick for mining, the cutting pick comprising:

an elongate steel shank;

a cutting tip fixed to a cylindrical end section of the shank to project axially with respect to the lengthwise axis of the shank and which is of a material that is harder than the material of the shank; and a composite sleeve formed of a plurality of annular sleeve portions which are attached about the cylindrical end section and which are of a material that is harder than the material of the shank and which extend substantially the full height of the end section and which have a lower propensity for incendiary spark production during a cutting operation than the steel of the shank, the method comprising the step of mining in gas and/or mine dust containing environments.

11. The method according to claim 10, wherein the environment includes methane gas.

12. The method according to claim 10 wherein the plurality of annular sleeve portions are attached about the shank immediately adjacent to each other.

* * * * *